United States Patent [19]

Wood et al.

[11] Patent Number: 4,895,287

[45] Date of Patent: Jan. 23, 1990

[54] WEB LOADING AND FEEDING SYSTEM

[75] Inventors: Kenneth O. Wood, Ellington; John E. Ladue, Tolland; David J. Logan, Glastonbury, all of Conn.

[73] Assignee: Gerber Scientific Products, Inc., Manchester, Conn.

[21] Appl. No.: 288,148

[22] Filed: Dec. 22, 1988

Related U.S. Application Data

[60] Continuation-in-part of Ser. No. 156,730, Feb. 17, 1988, abandoned, which is a division of Ser. No. 73,404, Jul. 13, 1987, abandoned, which is a continuation of Ser. No. 809,053, Dec. 13, 1985, abandoned.

[51] Int. Cl.[4] ..... B65H 20/20

[52] U.S. Cl. ..... 226/76; 226/74; 226/87; 282/11.5 A; 282/21 D

[58] Field of Search ..... 226/74, 76, 87; 282/11.5 R, 11.5 A, 21 D

[56] References Cited

U.S. PATENT DOCUMENTS

| | | | |
|---|---|---|---|
| 1,144,414 | 6/1915 | Holmes | 226/87 X |
| 1,368,994 | 2/1921 | Johnson | 282/21 D |
| 2,352,757 | 7/1944 | Barker | 282/11.5 R |
| 4,834,276 | 5/1989 | Logan | 226/76 |

FOREIGN PATENT DOCUMENTS 841909 9/1984 South Africa .

*Primary Examiner*—John Petrakes

*Attorney, Agent, or Firm*—McCormick, Paulding & Huber

[57] ABSTRACT

A web loading and feeding system comprises an elongated web and a web loading and feeding machine. The web is fed longitudinally of itself through the machine by a pair of drive sprockets having pins which cooperate with holes in side edge portion of the web. The hole arrangement in the web and the pin arrangement on the sprockets readily enable a machine operator to visually determine how to properly load the web onto the sprockets.

6 Claims, 6 Drawing Sheets

WEB LOADING AND FEEDING SYSTEM

CROSS REFERENCE TO RELATED APPLICATION

This application is a continuation-in-part of application Ser. No. 07/156,730 filed Feb. 17, 1988, which in turn is a division of application Ser. No. 07/073,404 filed July 13, 1987 which in turn is a continuation of application Ser. No. 06/809,053 filed Dec. 13, 1985, now abandoned.

BACKGROUND OF THE INVENTION

The invention relates generally to a web loading and feeding system including a web and a web handling machine such as a plotter, recorder or sign maker. The web is fed longitudinally of itself through the machine by a pair of sprockets cooperating with holes in two longitudinal side edge portions of the web. The invention deals more particularly with the web for the machine and the pair of sprockets within the machine, the web having a hole arrangement and the sprockets having a pin arrangement which together indicate the proper loading orientation of the web on the sprockets.

Sprockets in machines of the type with which this invention is concerned are typically mounted for rotation about a common drive axis and have pins or teeth-like members on their peripheries which engage rows of holes in two side edge portions of a web being fed. To ensure error free operation, it is important that the web is properly loaded on the machine so that the sprocket pins engage the correct web holes. This means that two corresponding pins of the two sprockets located in a common plane passing through the sprocket drive axis engage two corresponding holes in the web located on a common line extending perpendicular to the longitudinal side edges of the web. When the web is very wide, it is difficult to visually determine which sprocket pins correspond with one another and which holes on the opposite sides of the web correspond with one another and, as a result, web loading errors may occur. The resultant errors in pattern cutting or plotting may be small depending on the degree of misalignment, so the error may go undetected for a considerable period of time, wasting much web material and human labor.

Patent application Ser. No. 529,960 by Logan filed Sept. 6, 1983 and now U.S. Pat. No. 4,834,276, and corresponding South African Patent No. 84/1909 issued on 9-26-84 disclose a web loading and feeding system which provides means to identify the proper loading orientation of a web on a pair of drive sprockets. As disclosed there in reference to one embodiment of that invention, each of the sprockets has a series of radially, outwardly extending driving pins uniformly spaced around the sprocket's periphery and an extra keying pin situated between two of the driving pins. The keying pins of the two sprockets are located in a common plane passing through the axis of the sprockets. An associated web has a longitudinal row of uniformly spaced driving holes in each side edge portion, the spacing of the driving holes corresponds to the spacing of the driving pins. In addition to the driving holes, the web has a longitudinal row of keying holes in each side edge portion, the keying holes in one side edge portion laterally align with the keying holes in the other side edge portion. Also, the spacing of the keying holes in each row corresponds to the size of the sprocket and the location of the keying pins so that the web may be correctly loaded on the sprockets by placing a pair of laterally aligned keying holes over the keying pins of the sprockets.

In the No. 529,960 embodiment described above, the keying pins and the driving pins on both sprockets have the same shape, and the keying pin on each sprocket is somewhat spaced from the closest driving pin. Also, in that embodiment, the keying holes in each side edge portion have the same shape as the driving holes and each keying hole is spaced from the nearest driving hole by a distance corresponding to that between the keying pin and the closest driving pin.

Such a web loading and feeding system has proven effective in minimizing web loading errors of the foregoing type; however, it is desirable to further improve the ease at which and the assurance with which the proper web loading orientation may be visually determined.

Accordingly, a general aim of the invention is to provide a web loading and feeding system comprising a web having a hole arrangement and sprockets having a pin arrangement which web and sprockets readily enable a machine operator to visually determine which holes of the web to place over which pins on the sprockets to properly load the web.

A more specific aim of the invention is to provide a web of the foregoing type having a hole arrangement which wastes little of the web material.

Other aims and advantages of the invention will become apparent from the following detailed description of the preferred embodiments and from the accompanying drawings.

SUMMARY OF THE INVENTION

The invention resides in an elongated web for a web handling machine and a pair of web drive sprockets within the machine, which web and sprockets readily enable an operator to visually determine how to properly load the web onto the sprockets and make it virtually impossible for the machine to feed an improperly loaded web without the error being obvious. According to one feature of the invention, each of the sprockets has a series of radially outwardly extending driving pins located in a common plane and uniformly spaced from one another around most of its periphery; the driving pins of one sprocket laterally align with the driving pins of the other sprocket. Each sprocket also includes at least one keying pin having a shape and appearance different from that of the driving pins which keying pin or pins emanate from the remaining portion of the periphery; the keying pin or pins of one sprocket laterally align with the keying pin or pins of the other sprocket.

Also, according to this feature of the invention, the web includes driving holes located in each side edge portion, which driving holes are co-linear with one another and grouped into sets separated by keying zones. Each driving hole on one side of the web is laterally aligned with a driving hole on the other side of the web, and each keying zone includes one keying hole which, in turn, receives a keying pin of each sprocket. The shape of the keying holes is different than the shape of the driving holes, particularly insofar as each keying hole has a length much larger than each driving hole. Also each keying zone has a length greater than two times and less than three times the length of the regular spacing between the driving holes. Therefore, the keying zones and keying holes are easily identified for placement of the keying holes on corresponding keying pins to assure proper web loading.

DETAILED DESCRIPTION OF THE PREFERRED EMBODIMENT

Figure 1:
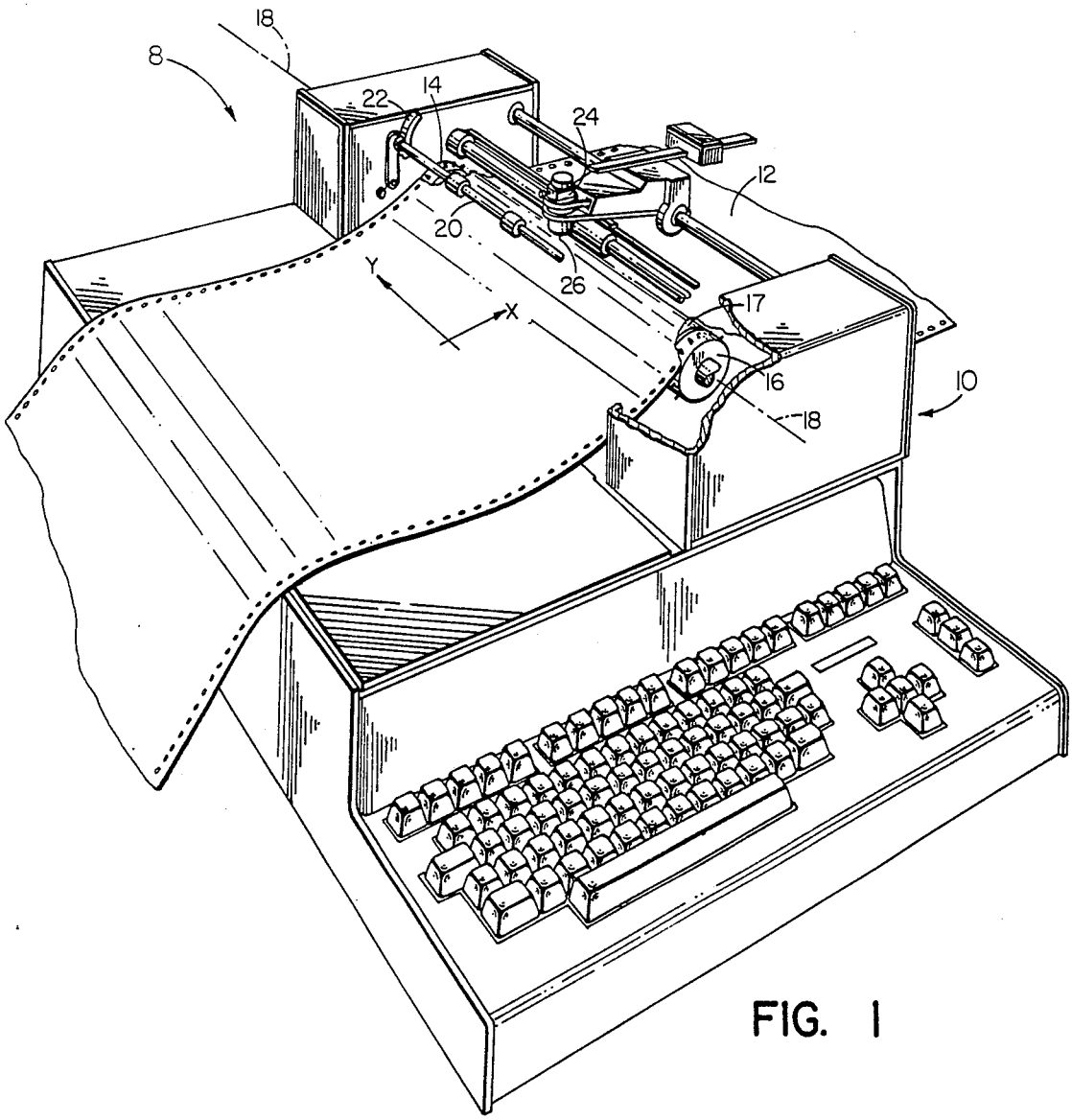
FIG. 1 is a perspective view of a sign making machine and a web which embody the present invention with various portions of the machine and the web being broken away to reveal additional features.

Referring to FIG. 1, the invention is there illustrated as embodied within a web loading and feeding system 8 which includes a sign making machine 10 and an associated web 12. The machine 10 is of the type shown and described in more detail in U.S. Pat. No. 4,467,525 to Logan and Sullivan issued Aug. 28, 1984, assigned to the assignee of the present invention and hereby adopted by reference as part of the present disclosure. The web has holes (discussed in more detail below) in its side edge portions and is moved longitudinally of itself, in the illustrated X-coordinate direction, by a pair of drive sprockets 14,16 which are supported for driven rotation in unison about a common drive axis 18 and have pins or teeth which engage the holes. A platen or roller 17 located between the two sprockets 14 and 16, and similar to that of a typewriter, supports a transverse portion of the web 12 aligned with the sprockets 14,16.

The machine 10 further includes two web holddown bails, one for each sprocket 14 and 16, carried by a transverse rod 20 which bails normally hold the web in engagement with the sprockets. In FIG. 1 only one such holddown bail 22 associated with the sprocket 14 is shown and this bail along with the supporting rod 20 is shown in its raised position to give a clearer view of the associated sprocket.

The machine 10 also includes a tool head 24 suitably supported and driven in the illustrated Y-coordinate direction relative to the web 12.

In a normal sign making mode of operation, the tool head 24 is equipped with a knife-type cutter 26 and the web 12 is an elongated piece of sign making stock. The web 12 and the tool 26 are moved relative to one another simultaneously in the X- and Y-coordinate directions through the operation of the machine 10 to cut alphanumeric characters or other indicia from the sign making stock. Later, the cut characters or indicia are transferred to another carrier to form a finished sign.

The machine 10 also may be operated in a plotting mode during which a pencil or other plotting instrument is placed in the head 24 in place of the cutting tool 26 and a webbed sheet of paper or the like is fed through the machine. One purpose of the plotting mode is to allow a proposed sign to be plotted first on paper to check the accuracy of the information entered into the machine before the more expensive sign making stock is cut.

Because the machine 10 is typically operated in both the plotting and cutting modes and many different sign patterns are plotted and cut during the course of a day and there is a wide variety of sign making web materials from which the patterns may be cut, an operator must load a web onto the machine many times each day. When the web is properly loaded, lines extending laterally of the web, that is perpendicular to its side edges, are parallel to the sprocket axis 18 as the web is fed longitudinally of itself through the machine by rotation of the sprockets. Typically, the web 12 may be wide, for example, fifteen inches, and the holes formed in each side edge portion of the web may be closely spaced to one another, for example, on one-half inch centers or less and if the web is loaded onto the sprockets even one hole out of alignment, errors in cutting or plotting may occur.

Figure 2:
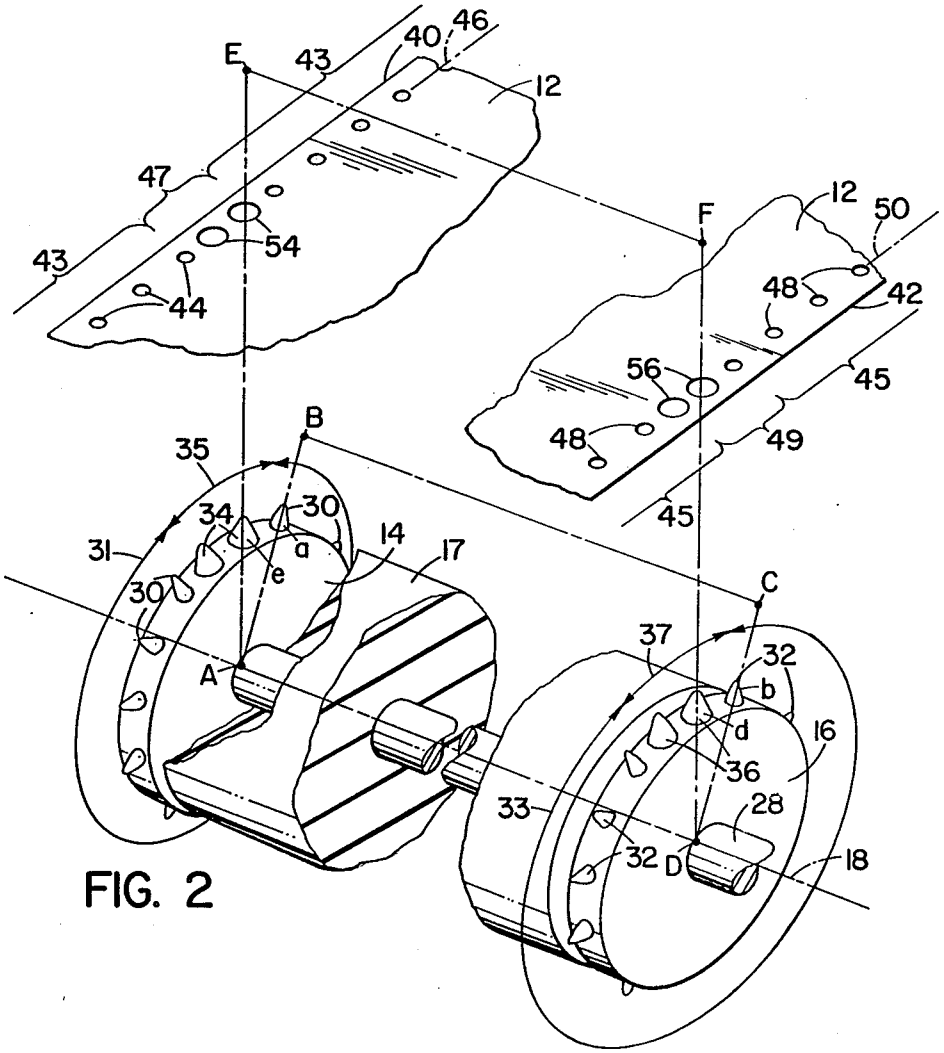
FIG. 2 is a fragmentary perspective view showing the relationship between the sprockets and the web during the loading of the web onto the machine of FIG. 1.

Referring to FIG. 2, the two sprockets 14 and 16 of the web loading and feeding system 8 are both fixed to a common drive shaft 28 for rotation about a common axis 18. The sprocket 14 has a series of radially outwardly extending driving pins 30, 30 located in a common plane perpendicular to the axis 18 and uniformly spaced from one another around a large portion of the perimeter of the sprocket 14 as indicated by an arc 31. In a manner identical to the spacing of the driving pins 30, 30 of the sprocket 14, the sprocket 16 has a series of radially outwardly extending driving pins 32, 32 located in a common plane perpendicular to the axis 18 and uniformly spaced from one another around a large portion of the perimeter of the sprocket 16 as indicated by an arc 33. In the illustrated embodiments the number of pins 30, 30 on the sprocket 14 and the number of pins 32, 32 on the sprocket 16 is twelve; however, this number may vary from device to device. Furthermore, the sprockets 14 and 16 are so relatively arranged that each pin 30 is at least substantially aligned with and corresponds to a pin 32 so that each corresponding pair of pins are located in, or at least substantially in, a common plane passing through the axis 18. For example, in FIG. 2 one such common plane is shown at ABCD and contains a pair of corresponding pins 30 and 32 indicated as a and b.

In keeping with the invention, the sprocket 14 includes two enlarged keying pins 34, 34 and the sprocket 16 includes two enlarged keying pins 36,36. The keying pins 34,34 are located on a portion of the periphery of the sprocket 14 defined by an arc 35 which portion compliments the much larger portion defined by the arc 31 and are also located in the same plane perpendicular to the sprocket axis 18 as the driving pins 30, 30. Likewise the keying pins 36,36 are located on a portion of the periphery of the sprocket 16 defined by an arc 37 which portion compliments the much larger portion defined by the arc 33 and are also located in the same plane perpendicular to the sprocket axis 18 as the driving pins 32,32. Each keying pin 34 aligns with and corresponds to a keying pin 36 so that each corresponding pair of such keying pins is located in a common plane passing through the axis 18, such as a plane at AEFD containing the keying pins indicated as d and e.

The pair of keying pins 34, 34 stands out from the driving pins 30, 30 because the keying pins of the pair are larger and spaced closer to each other than are the driving pins 30, 30, and likewise the pair of keying pins 36,3 stands out from the driving pins 32,32 because the keying pins 36,36 are larger and spaced closer to each other than are the driving pins 32,32. Consequently, the keying pins 34,34 and 36,36 visually identify laterally aligned portions of the sprockets 14 and 16 to aid in loading the web correctly.

Figure 6:
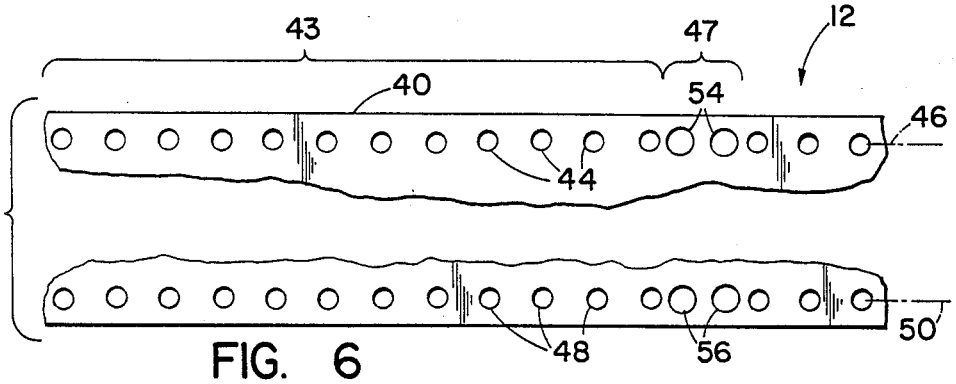
FIG. 6 is an enlarged scale, fragmentary plan view of the web of FIG. 4.
Figure 3:
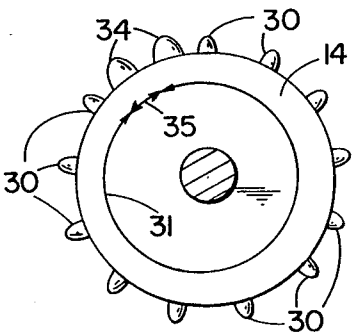
FIG. 3 is a side view of one of the sprockets of FIG. 1.
Figure 4:
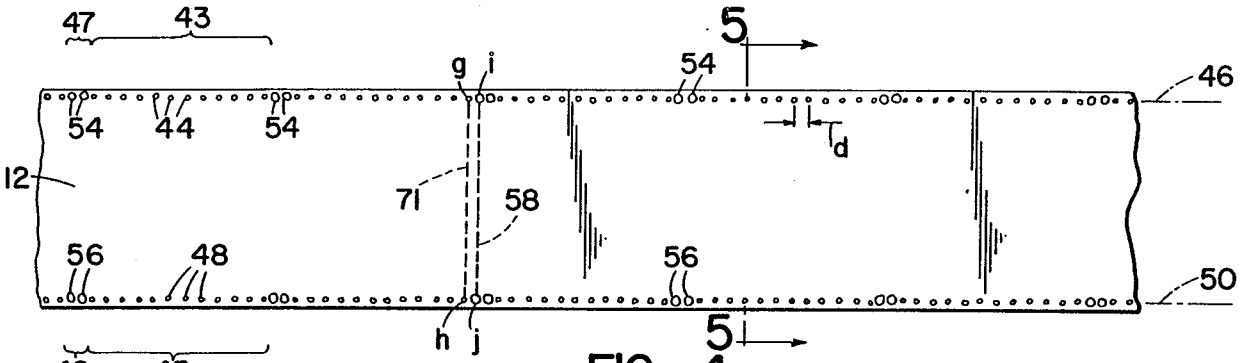
FIG. 4 is a reduced scale plan view of a portion of the web of FIG. 1.

The web 12, as shown in FIGS. 2, 4 and 6, comprises an elongated piece of sheet-like material having parallel side edges 40 and 42. Sets or row segments 43,43 of the driving holes 44,44 are located in a side edge portion of the web 12 adjacent the side edge 40. All the holes of all the row segments 43,43 are located on a first line 46 spaced slightly inwardly from the edge 40 and the holes within each row segment are uniformly spaced from one another by a spacing corresponding to the spacing between the pins 30, 30 of the sprocket 14. Likewise, sets or row segments 45,45 of driving holes 48,48 are located in an edge portion adjacent the edge 42. All the holes of all the row segments 45,45 are located on a line 50 spaced slightly inwardly from the edge 42 and the holes within each row segment are uniformly spaced from one another by a spacing corresponding to the spacing between the driving pins 32,32 and equal to that of the spacing of the driving holes 44,44.

Furthermore, as shown in FIG. 4 each driving hole 44 laterally aligns with and corresponds to a driving hole 48, for example, the driving holes identified as g and h lie on a common line 71 extending perpendicular to the web side edges and perpendicular to the lines 46 and 50 containing the rows of holes.

The web 12 also includes enlarged keying holes 54,54 on the line 46 within keying zones 47,47 which keying zones and keying holes separate the row segments 43,43 from one another. Likewise the web 12 includes enlarged keying holes 56,56 on the line 50 within keying zones 49,49 which keying zones and keying holes separate the row segments 45,45 from one another. All the holes in the web 12 are shown as being round, but this need not always be the case. As shown in FIGS. 2, 4 and 6, the keying holes 54,54 within each keying zone 47 are spaced closer to each other than are two adjacent drive holes 44,44 within each row segment 43. By way of example, the distance between the center of the driving hole 44 adjacent one side of the keying zone 47 and the center of the driving hole 44 adjacent the other side of the keying zone 47 is twice the distance between the centers of any two adjacent driving holes 44,44 within a row segment. Furthermore, in this example the keying holes 54,54 within each keying zone straddle a point on the web equidistant between the two adjacent, surrounding driving holes 44,44; the distance from each of these driving holes 44 to the equidistant point equals the distance between two adjacent drive holes within each row segment 43. Similarly the keying holes 56,56 straddle a point equidistant between the two adjacent, surrounding drive holes 48,48; the distance from each of these driving holes 48 to the equidistant point equals the distance between two adjacent driving holes within each row segment 45.

Each keying hole 54 laterally aligns with and corresponds to a keying hole 56, for example, the keying holes identified as i and j in FIG. 4 lie on a common line 58 extending perpendicular to the side edges 40, 42 of the web and to the lines 46 and 50. Therefore, as evident from FIGS. 2 and 4, the keying holes 54,54 within one keying zone 47 and the corresponding keying holes 56,56, by their large size and close spacing, identify aligned regions of the side edge portions of the web to be placed over the keying pins 34,34 and 36,36 to ensure proper loading of the web 12 on the sprockets 14 and 16.

To load the web 12, the sprockets are turned to move the keying pins 34,34 and 36,36 upwardly to a web loading position and the web is then moved downwardly onto the sprockets bringing the keying holes 54,54 and 56,56 onto the keying pins 34,34 and 36,36 and bringing the drive holes 44,44 and 48,48 which surround the keying holes at least partially onto the corresponding driving pins 30,30 and 32,32. The engagement of the driving holes by the driving pins may be only partial because of the curvature of the sprockets 14 and 16. Accordingly, proper movement of the web from that point on is assured.

The holes 44,44 and 54,54 longitudinally align with one another as near the side edge 40 as practical to maximize the usable area of the web 12 but to avoid tearing when subjected to forces of engaging pins. For the same reasons and with the same constraints, the holes 48,48 and 56,56 longitudinally align with one another as near the side edge 42 as practical. Also, the longitudinal alignment of the holes 44,44 with the holes 54,54 and that of the holes 48,48 with the holes 56,56 allow the use of relatively simple sprockets 14 and 16. If the holes in one side edge portion of the web were not all longitudinally aligned with one another, then a second sprocket or a lateral extension of the respective sprocket 14 or 16 may be required to mount pins capable of reaching and engaging all the holes.

In the illustrated embodiment, pairs of keying holes 54,54 and pairs of keying holes 56,56 are spaced uniformly from one another along the length of the web by a distance S equal to $(N+1)d$, where d is the spacing between two driving holes 44,44 within a row segment and is the spacing between two adjacent driving holes 48,48 within a row segment, and where N is the number of driving pins 30,30 on the sprocket 14 and the number of driving pins 32,32 on the sprocket 16. In the illustrated case the number of pins 30,30 is twelve as is the number of pins 32,32 and therefore S equals 13d. Each time the sprockets 14 and 16 undergo one revolution the keying pins 34,34 engage two keying holes 54,54 and the keying pins 36,36 engage two corresponding keying holes 56,56, and the 12 driving pins 30,30 engage the 12 driving holes 44,44 within one row segment 43 and the 12 driving pins 32,32 engage the 12 driving holes 48,48 within one row segment 45.

Figure 5:
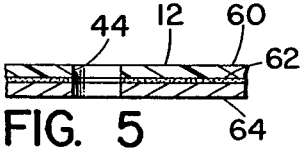
FIG. 5 is an enlarged scale, fragmentary sectional view through the web taken on the line 5—5 of FIG. 4.

As indicated previously, the web 12 may take various different forms and, in FIG. 5, the web 12 is shown to comprise a piece of sign making stock having an upper layer 60 and a release layer 64. The upper layer is made of a thermoplastic material such as vinyl on the order of three to five mils thick with an adhesive backing or coating 62. This upper layer is supported on the release layer 64 and releasably held by the adhesive backing 62. The release layer may consist of a ninety-pound paper coated or impregnated with silicone to give it its release property.

If a type of web utilized with the machine 10 exhibits significant variations in width due to variations in temperature and humidity or manufacture tolerance, then a spline shaft and a sprocket slidably mounted thereon may be substituted for the sprocket 14 and the shaft 28 to accommodate such variations.

Figure 7:
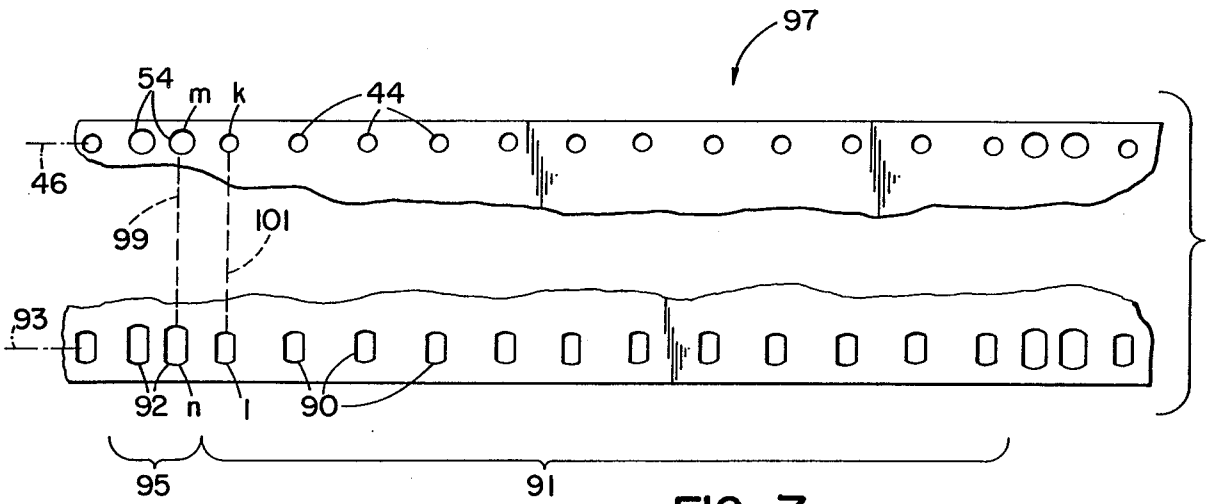
FIG. 7 is a reduced scale plan view of a portion of another web embodying the invention.

FIG. 7 illustrates another web 97 embodying the invention, which web is adapted to fit over the sprockets 14 and 16 despite the fact that the sprockets are fixed to the shaft and the width of the web 97 may differ from that of the web 12 due to variations in temperature and humidity or manufacture tolerance. The web 97 is identical to the web 12 except that the web 97 includes row segments 91,91 of laterally elongated driving holes 90,90 instead of row segments 45,45 of the round driving holes 48,48, and laterally elongated keying holes 92,92 instead of the round keying holes 56,56, the lateral elongation of the driving and keying holes compensates for the variation in web width by accommodating the driving and keying pins of the sprocket 16 despite such variations.

The keying holes 92,92 are located in keying zones 95,95 between the row segments, and the driving holes 90,90 and the keying holes 92,92 are located along a line 93 parallel to the side edges of the web 97. Each driving hole 90 laterally aligns with and corresponds to a driving hole 44 as indicated by a line 101 which is perpendicular to the side edges of the web and the line 93 and passes through the driving hole 44 indicated as k and the driving hole 90 indicated as 1. Each keying hole 92 laterally aligns with and corresponds to one of the keying holes 54 as indicated by a line 99 which is perpendicular to the side edges of the web 97 and passes through the keying hole 54 indicated as m and the keying hole 92 indicated as n. The keying holes 92,92 are wide enough in the longitudinal direction to fit over the keying pins 36,36, and the driving holes 90,90 are wide enough in the longitudinal direction to fit over the driving pins 32,32 but not over the keying pins 92,92. Also, the keying holes 92,92 are somewhat longer in the transverse direction than the driving holes 90,90 because the keying pins are broader than the driving pins. Also, because the keying holes 92,92 of each keying zone are longer, wider, and spaced closer to each other than are the driving holes 90,90, the keying holes stand out, and because the keying holes 92,92 within each keying zone 93 laterally align with the corresponding keying holes 54,54, the keying holes 92,92 and 54,54 together with the keying pins 34,34 and 36,36 identify the proper loading orientation of the web 97.

Figure 9:
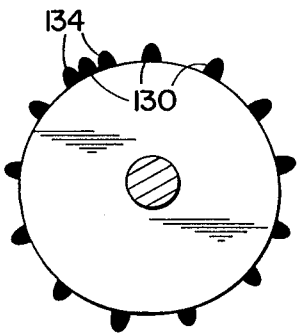
FIG. 9 is a side view of one of the sprockets of FIG. 8.
Figure 8:
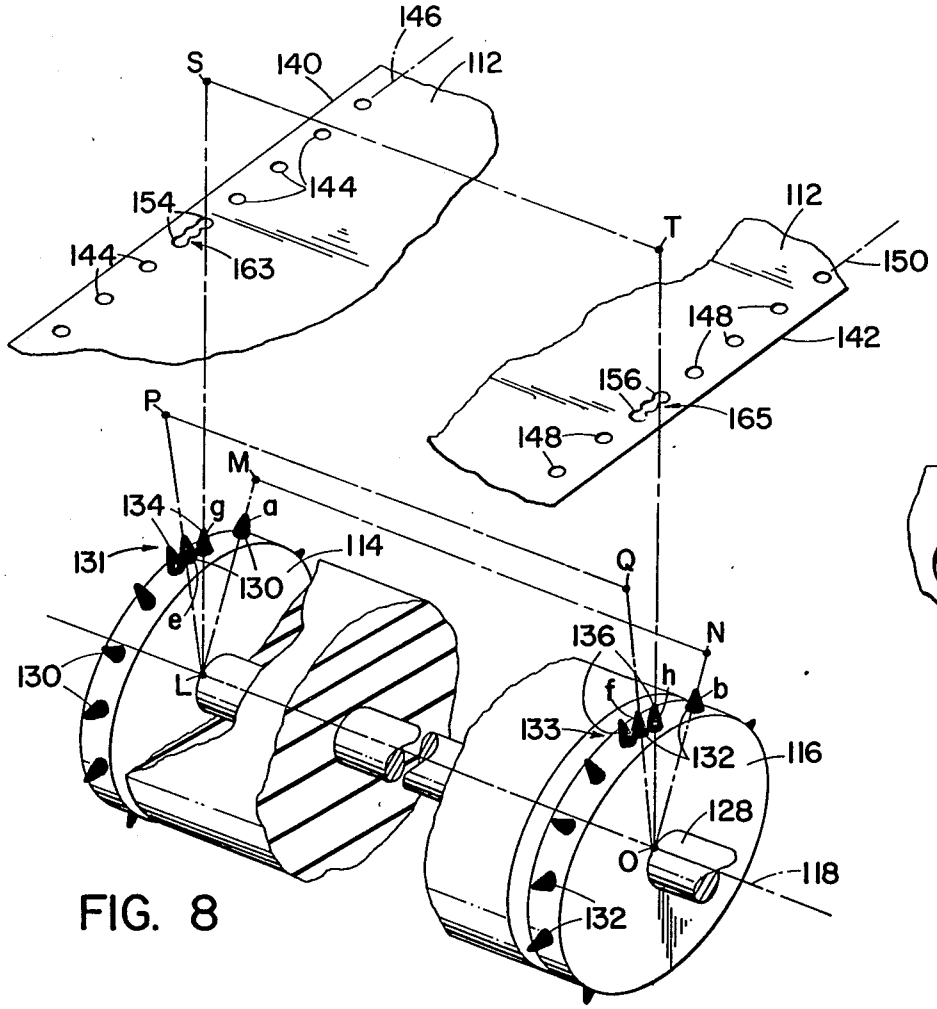
FIG. 8 is a fragmentary perspective view of another web and a pair of sprockets which embody the invention and shows the relationship between the sprockets and the web during the loading of the web.
Figure 10:
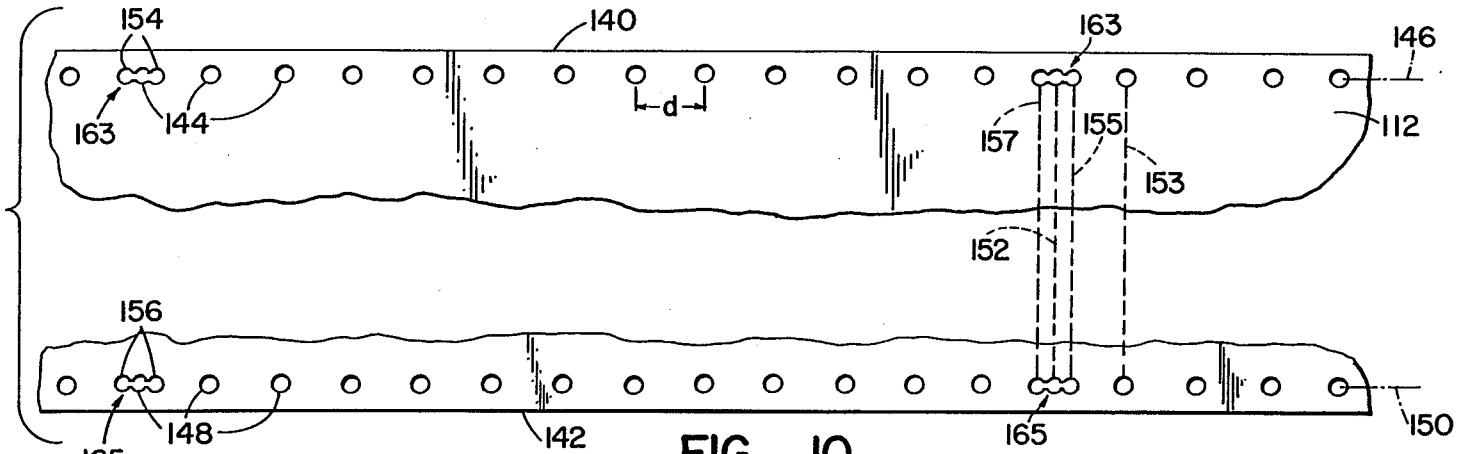
FIG. 10 is a reduced scale plan view showing a portion of the web of FIG. 8.

FIGS. 8–10 illustrate another preferred embodiment of the invention, and more specifically, FIG. 8 shows two sprockets 114 and 116 fixed to a common drive shaft 128 for rotation about a common axis 118. The sprocket 114 has a series of radially outwardly extending driving pins 130,130 located in a common plane perpendicular to the axis 118 and uniformly spaced from one another entirely around the periphery of the sprocket. The sprocket 116 has a similar series of radially outwardly extending driving pins 132,132 located in a common plane perpendicular to the axis 118 and, in a manner identical to the spacing of the pins 130,130 on the sprocket 114, the driving pins 132,132 are uniformly spaced from one another entirely around the periphery of the sprocket 116. The number of pins 130,130 and 132,132 may vary from application to application, but in the illustrated case the sprocket 114 has thirteen pins 130,130 and the sprocket 116 likewise has thirteen pins 132,132. Furthermore, the sprockets 114 and 116 are so relatively arranged that each driving pin 130 on the sprocket 114 aligns with and corresponds to a driving pin 132 on the sprocket 16, each pair of which corresponding driving pins are located in a common plane passing through the axis 18. For example, in FIG. 8 one such common plane LMNO contains a pair of corresponding driving pins 130 and 132 indicated as a and b, respectively and another such common plane LPQO contains a pair of corresponding driving pins 130 and 132 indicated as e and f.

The sprocket 114 includes two extra keying pins 134,134 which closely surround the driving pin 130 indicated as e and the sprocket 116 includes two extra keying pins 136,136 which closely surround the driving pin 132 indicated as f.

Each keying pin 134 aligns with and corresponds to a keying pin 136 as illustrated by a plane LSTD containing the axis 118 and intersecting two such corresponding keying pins 134 and 136 indicated as g and h, respectively.

The keying pins 134,134 and the associated driving pin 130 form a cluster of pins or keying projection 131 which stands out from the other pins on the sprocket 114 and, similarly, the keying pins 136,136 and associated driving pin form a cluster of pins or keying projection 133 which stands out from the other pins on the sprocket 116. If desired, each keying projection 131 and 133 may also be made as a unitary member rather than being comprised of three separate pins. The two keying projections 131 and 133 identify aligned portions of the sprockets 114 and 116. The keying projections also serve to drive the web when such projections engage keying openings in the web.

Figure 11:
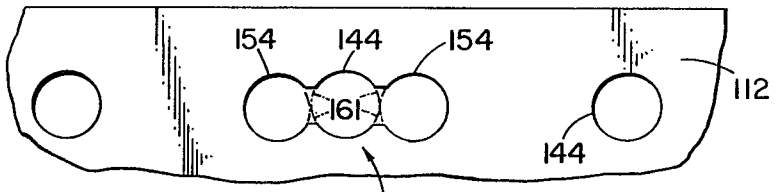
FIG. 11 is an enlarged scale, fragmentary plan view of the web of FIG. 8.

The web 112, as shown in FIGS. 8, 10 and 11 comprises an elongated piece of sheet-like material made from any material from which the web 12 may be made and has parallel side edges 140 and 142. A row of driving holes 144,144 is located in a side edge portion of the web 112 adjacent the side edge 140 on a line 146 spaced slightly inwardly from the edge 140, which holes are uniformly spaced from one another by a spacing corresponding to the spacing between the pins 130,130 of the sprocket 114. Likewise, a row of driving holes 148,148 is located in a side portion adjacent the edge 142 on a line 150 spaced slightly inwardly from the edge 142 which holes are uniformly spaced from one another by a spacing equal to that of the spacing of the holes 144,144. Each driving hole 144 laterally aligns with and corresponds to a driving hole 148 as indicated by lines 152 and 153 shown in FIG. 10 which lines extend perpendicular to the side edges 140 and 142.

The web 112 also includes keying holes 154,154 located on the same line 146 as the driving holes 144,144 and keying holes 156,156 located on the same line 150 as the driving holes 148,148. The keying holes 154,154 laterally align with corresponding keying holes 156,156 as indicated by lines 155 and 157 shown in FIG. 10 which extend perpendicular to the side edges 140 and 142 of the web 112. All the holes in the web 112 are shown as being round, but this need not always be the case. The keying holes 154,154 are situated in pairs at intervals along the length of the web, each pair closely surrounding and adjoining an associated driving hole 144 forming a cluster of three holes. Local webbings 161,161 (indicated in FIG. 11 by broken lines) between the keying holes and the associated driving hole are omitted from webs made of paper, sign making stock, and other web materials because such local webbing was found to be too flimsy to contribute much in the way of drive engagement with the driving and keying pins and often broke from the web and littered the machine 10. Also, the removal facilitates the visual identification of the clusters for loading purposes. Thus a pair of keying holes 154,154 and an associated drive hole 144 form an interconnected cluster of holes which together provide a single keying opening 163 which is elongated in the longitudinal direction of the web 112 so as to have a shape and length different from the driving holes 144 and so as to therefore stand out from the other holes because of its shape and large size. Likewise, the keying holes 156,156 are situated in pairs at intervals along the length of the web, each pair closely surrounding an associated driving hole 148, so close that local webbings analogous to the local webbings 161,161 are omitted for the reasons stated above. Thus, a pair of keying holes 156,156 and an associated driving hole 148 form an interconnected cluster of holes identical to that shown in FIG. 11, which cluster provides a single keying opening 165 standing out from the other holes. The illustrated keying openings 163 and 165 therefore each have a shape corresponding to three closely spaced circular holes with their centers on a line extending longitudinally of the web 112 and spaced from one another by the diameter of each hole. Such shape however is not essential to the broader aspects of the invention and other shapes elongated longitudinally of the web may be employed with the keying projections of the sprockets being complementarily shaped.

The holes 144,144 and 154,154 longitudinally align with one another as near the side edge 140 as practical to maximize the usable area of the web but to avoid tearing when subjected to forces from engaging pins. Similarly, the holes 148,148 and 156,156 longitudinally align with one another as near the side edge 142 as practical. Also, the longitudinal alignment of the holes 144,144 and 154,154 and that of the holes 148,148 and 156,156 allow the use of relatively simple sprockets; if any of such holes were out of alignment with the others, then a second sprocket or a lateral extension of the sprockets 114 and 116 may be required to provide pins which are able to reach all of the holes.

To load the web 112 onto the sprockets 114 and 116, the sprockets are turned to move the keying projections 131 and 133 upwardly to a web loading position. Then, the web 112 is moved over the sprockets until a corresponding pair of keying openings 163 and 165 as shown in FIG. 8 are located above the keying projections and the web is moved downwardly onto the sprockets bringing the keying openings onto the keying projections. Thereafter, proper movement of the web is assured.

With reference to FIG. 10, the keying openings 163 are spaced uniformly from one another along the length of the web at intervals S equal to Nd, where d is the spacing or interval between adjacent driving holes 144,144 is the spacing between adjacent driving holes 148,148, and where N is the number of driving pins 130,130 on the sprocket 114 and is the number of driving pins 132,132 on the sprocket 116. In the illustrated case, the number of pins 130,130 and 132,132 is thirteen and therefore, its keying openings 163 occur periodically along the length of the web at intervals S=13d and likewise the keying openings 165 occur periodically along the length of the web at intervals S=13d. Furthermore, each time the sprockets 114 and 116 undergo one revolution the keying projections 131,133 enter one pair of keying openings 163,165. If the width of the web 112 may vary due to variations in temperature and humidity or manufacture tolerance, then one of the sprockets 114 or 116 may be slidably mounted on the shaft 128 or on a spline shaft.

Even though each keying opening 163 or 165 has been described as including two keying holes and one adjoining driving hole, each keying opening may alternatively be viewed as one enlarged, irregularly shaped hole or opening situated within a keying zone, which keying zone and associated keying opening separate two adjacent row segments of driving holes.

Figure 12:
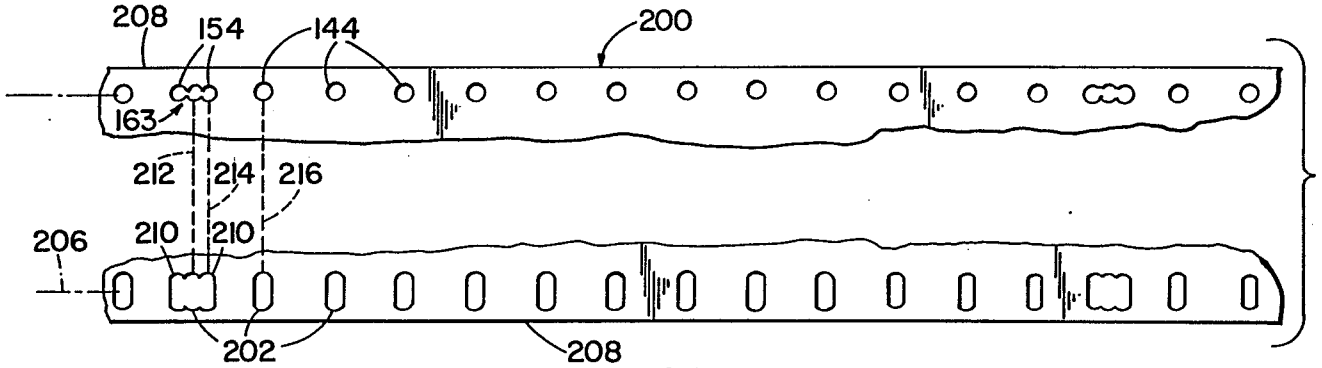
FIG. 12 is a reduced scale plan view of a portion of another web embodying the invention.

FIG. 12 illustrates another web 200 embodying the invention which web is similar to the web 112 except that the web 200 includes laterally elongated drive holes 202,202, instead of the round drive holes 148,148 and laterally elongated keying holes 210,210, instead of the round keying holes 156,156.

The purpose of providing laterally elongated holes 210,210 and 202,202 in one side edge portion of the web is the same as providing the laterally elongated holes in the web 97, to allow the web 200 to readily fit over the pins of both sprockets 114 and 116 despite the fact that the sprockets 114 and 116 are fixed to the shaft 128 and the width of the web 200 differs from that of the web 112 and varies slightly from web to web for the reasons discussed above.

The keying holes 210,210 and the driving holes 202,202 are located along a line 206 parallel to the sides of the web 200 and inwardly spaced from one side edge 208. As indicated by lines 212, 214 and 216 which are perpendicular to the side of the web, the holes 202,202 and 210,210 laterally align with and correspond to the holes 144,144 and 154,154, respectively.

Figure 14:
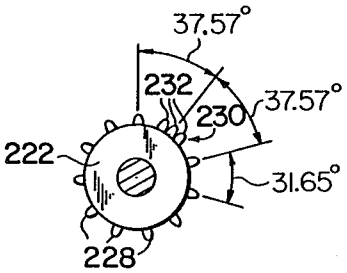
FIG. 14 is a side view of a sprocket for use with the web of FIG. 13.
Figure 13:
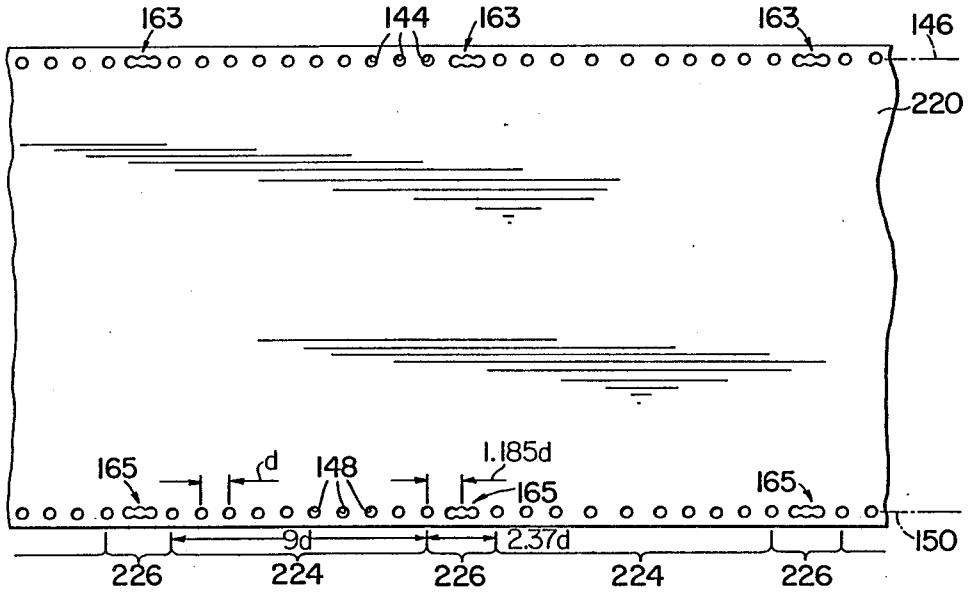
FIG. 13 is a plan view of another web embodying the invention.

FIGS. 13 and 14 show parts of an exemplary web loading and feeding system comprising another embodiment of the invention. FIG. 13 shows the web 220 of the system, and FIG. 14 shows one sprocket 222, two of which are used in place of the sprockets 14 and 16 of the machine 10 of FIG. 1 to feed the web 220.

The web 220 is generally similar to the web 112 of FIGS. 8 to 11 except that along each side edge of the web each keying zone has a length which is not an integral multiple of the regular spacing between the driving holes, and except for there being a different number of driving holes between successive keying zones. The non-integral length of the keying zones in combination with the fact that the keying opening in each keying zone has a length and shape different from each driving hole therefore makes the keying zones and keying openings still more visibly discernable from the driving holes.

In particular, the illustrated web 220 along one side edge has a plurality of driving holes 144 and keying openings 163 arranged along a straight line 146 extending longitudinally of the web. In the other side edge portion of the web are a plurality of driving holes 148 and keying openings 165 arranged along another straight line 150 extending longitudinally of the web.

As shown for the holes and openings on the line 150 of FIG. 13, the driving holes 148 are located in row segments 224 spaced from one another by keying zones 226. The driving holes 48 are all of uniform circular size and shape and are spaced from one another by a regular interval or spacing d. Each row segment 224 has a length of 9d so as to start at the center of a first driving hole 148 and to stop at the center of a tenth driving hole 148. Each keying zone 126, as mentioned, has a length greater than two times and less than three times the regular spacing d of the driving holes. The exact length of the keying zone may vary, but in the illustrated case such length is shown to be 2.37 d.

Each keying opening 165 of the web 220 of FIG. 13 has a shape similar to the keying opening 163 shown in FIG. 11. That is, each keying opening 165 has a shape corresponding to three driving openings 148 arranged close to one another along the line 50 and communicating with one another so as to form a single elongated opening. Preferably, and as shown in FIG. 11, the three holes making up each keying opening are arranged with their centers spaced from one another by a distance substantially equal to the diameter of each hole, and small portions of the web, such as indicated at 161 in FIG. 11 by the broken lines, are also omitted, giving the keying opening a more unitary appearance.

The driving holes 144 and keying openings 163 arranged along the other edge of the web 220 are arranged similarly to the driving holes 148 and keying openings 165, with one driving hole 144 being located transversely opposite a driving hole 148 and with each keying opening 163 being located transversely opposite a keying opening 165. Therefore, each pair of keying openings 163 and 165 constitutes a pair visibly distinguishable from the driving holes aiding in the proper location of the web 220 on the associated sprockets of the machine 10.

A sprocket 222 for use with the web 220 of FIG. 13 is illustrated in FIG. 14. As there illustrated, the sprocket has ten driving pins 228 located along a first circumferential portion of the sprocket and regularly spaced from one another by a spacing of 31.65°. The sprocket also includes a keying projection 230 comprised of three closely spaced pins 232,232. The center one of these pins 232 is located midway between the adjacent two of the driving pins 228. That is, the middle pin 232 is located 37.57° from the driving pin 228 located on one side of it and is located 37.57° from the driving pin 228 located on the other side of it.

In use with the web 220 of FIG. 13 two sprockets 222 such as shown in FIG. 14 replace the sprockets 14 and 16 of the machine 10 as shown in FIG. 1. During loading of the web onto the machine a pair of keying openings 163 and 165 is fitted over the two keying projections 230 on the two sprockets. Thereafter, as the sprockets rotate the driving pins 228 of the sprockets enter and cooperate with the driving openings 144 and 148 of the web and the keying projections 230 enter and cooperate with the driving openings 163 and 165 to feed the web longitudinally of itself.

By the foregoing, web loading and feeding systems have been disclosed embodying the present invention. However, numerous modifications and substitutions may be made without deviating from the spirit of the invention. For example, the keying projections and the driving pins on any sprocket may be made a different color to further visually identify corresponding, aligned portions of the sprockets. In addition, the driving holes and keying openings may be made square and/or rectangular if desired. Also, the local webbings 161,161 of the web 112 need not be removed if desired.

It is also possible to provide a web loading and feeding system similar to that of the system 8 in which the pins on one sprocket are angularly advanced relative to the corresponding pins on the other sprocket, and the holes in the corresponding side edge portion of the web are similarly, longitudinally advanced relative to the holes in the other side edge portion.

Therefore, the invention has been described by way of illustration and not by limitation.

We claim:

1. A web for use with a web handling machine having a pair of web feeding sprockets mounted for rotation about a common axis, each sprocket having a circumference with a first portion which contains only a plurality of driving pins spaced uniformly along said first portion of said circumference and a second portion which contains a keying projection, said driving pins and said keying projection of each web feeding sprocket being located in a common plane perpendicular to said common axis, said web comprising:

an elongated sheet-like member having parallel side edges and a plurality of driving holes and keying openings in each side edge portion for cooperation, respectively with said driving pins and said keying projection of a respective one of said sprockets to feed said web longitudinally of itself, said driving holes and said keying openings in each side edge portion of said web being located on a straight line extending longitudinally of said web, and said driving holes in each side edge portion of said web being arranged in row segments, each row segment being separated from a next row segment by a keying zone including no openings except for one of said keying openings, said driving holes of said row segments being spaced from one another at regular intervals along the length of each of said row segments and said driving holes being of uniform size and shape, each of said keying zones having a length greater than two times and less than three times the length of one of said regular intervals, and said keying opening of each keying zone being elongated in the direction longitudinally of said web so as to have a length and a shape different from each of said driving holes, so that each keying zone represents a readily visibly discernable interruption in the regular spacing of said driving hole insofar as each keying zone has a length not an integral multiple of the length of one of said regular intervals and insofar as the keying opening of each keying zone has a shape different from and a length longer than each of said driving holes.

2. A web as set forth in claim 1 wherein said driving holes and said keying openings in one side edge portion of said web are substantially laterally aligned with said driving holes and said keying openings respectively, in the other side edge portion of said web.

3. A web as set forth in claim 1 wherein each of said keying openings in each of the keying zones of one side edge of said web has a shape corresponding to a number of holes similar in size and shape to the driving holes of the same side edge of said web arranged close to one another along the associated one of said straight lines and communicating with one another along the length of said web so as to collectively define one single opening.

4. A web as set forth in claim 1 wherein said driving holes are of circular shape, and each of said keying openings has a shape corresponding to a number of holes of size and shape similar to said driving holes and having their centers located on the associated one of said straight lines and spaced from one another along such line by a distance substantially equal to the diameter of each driving hole.

5. A web loading and feeding system comprising:

a pair of web feeding sprockets mounted for rotation about a common axis, each sprocket having a first circumferential zone including a plurality of driving pins spaced uniformly along said first zone and having a second circumferential zone with a length greater than two times and less than three times the spacing between adjacent ones of said driving pins, a keying projection in said second circumferential zone, said sprockets being mounted for rotation about a common axis, and said driving pins and keying projection of each sprocket being located in a common plane perpendicular to said common axis, and a web comprising an elongated sheet-like member having parallel side edges and a plurality of driving holes and keying openings in each side edge portion located on a straight line extending longitudinally of said web, said driving pins and said keying projections of each sprocket cooperating with said driving holes and said keying openings, respectively, in each side edge portion of said web to feed said web longitudinally of itself, said driving holes and said keying openings in each side edge portion of said web being arranged in row segments, each row segment being separated from the next row segment by a keying zone having no openings except for one keying opening, said driving holes of each of said row segments being spaced from one another at regular intervals along the length of the associated one of said straight lines, said driving holes being of uniform size and shape, each of said keying zones having a length greater than two times and less than three times the length of one of said regular intervals, said keying opening of each keying zone being of a shape different from said driving holes and having a length along the associated one of said straight lines greater than that of said driving holes so that each keying zone represents a visibly discernable interruption in the regular spacing of said driving holes insofar as each keying zone has a length not an integral multiple of the length one of said intervals and insofar as the keying opening of each keying zone has a shape and length different from said driving holes.

6. A web loading and feeding system as set forth in claim 5 herein the keying opening in each of the keying zones of one side edge of said web has a shape corresponding to a number of holes of size and shape similar to that of the driving holes of the same side edge of said web arranged close to one another along the associated one of said straight lines and communicating with one another along the length of said web so as to collectively define one single opening.

* * * * *